US006932494B1

(12) United States Patent
Burnett et al.

(10) Patent No.: US 6,932,494 B1
(45) Date of Patent: Aug. 23, 2005

(54) GERMICIDAL LAMP RETAINING ASSEMBLY

(75) Inventors: Gregg Burnett, Rockwall, TX (US); Thomas K. Burk, Greenville, TX (US)

(73) Assignee: Dust Free, LP, Royse City, TX (US)

( * ) Notice: Subject to any disclaimer, the term of this patent is extended or adjusted under 35 U.S.C. 154(b) by 42 days.

(21) Appl. No.: 10/403,260

(22) Filed: Mar. 31, 2003

Related U.S. Application Data

(63) Continuation-in-part of application No. 10/026,167, filed on Dec. 21, 2001, now Pat. No. 6,539,727.

(51) Int. Cl.[7] ..... F21V 21/10; H01J 29/02
(52) U.S. Cl. ..... 362/287; 362/429; 250/522.1
(58) Field of Search ..... 248/205.1, 274.1; 362/285, 287, 289, 371, 429, 430; 250/522.1

(56) References Cited

U.S. PATENT DOCUMENTS 2,590,191 A * 3/1952 Logan ..... 362/33
2,614,471 A * 10/1952 Markowitz ..... 396/422
2,977,461 A * 3/1961 Jones ..... 362/296
2,982,508 A * 5/1961 Larsen et al. ..... 248/205.1
4,361,864 A * 11/1982 Spiro ..... 362/549
4,941,071 A * 7/1990 Knauf ..... 362/133
4,947,297 A * 8/1990 Druffel et al. ..... 362/147
5,023,765 A * 6/1991 Barton ..... 362/429
5,902,552 A 5/1999 Brickley
6,575,606 B2 * 6/2003 Shaw ..... 362/433
6,630,678 B2 * 10/2003 Guzorek ..... 250/432 R

OTHER PUBLICATIONS

Type 5069A–1 Air Sanitizer, Data Sheet, 1973, Emerson, White–Rodgers Division, St. Louis, MO.

* cited by examiner

*Primary Examiner*—William C. Doerrler
(74) *Attorney, Agent, or Firm*—Anderson, Levine & Lintel, LLP

(57) ABSTRACT

An angled germicidal lamp is used to illuminate a coil and drain pan for optimum energy utilization. An angled mount formed of two retention clips positions a germicidal lamp at a desired angle. A security access cover ensures that the germicidal lamp is disconnected from its power supply before access. Multiple germicidal lamps may be mounted by a single retention clip.

8 Claims, 5 Drawing Sheets

FIG. 6C
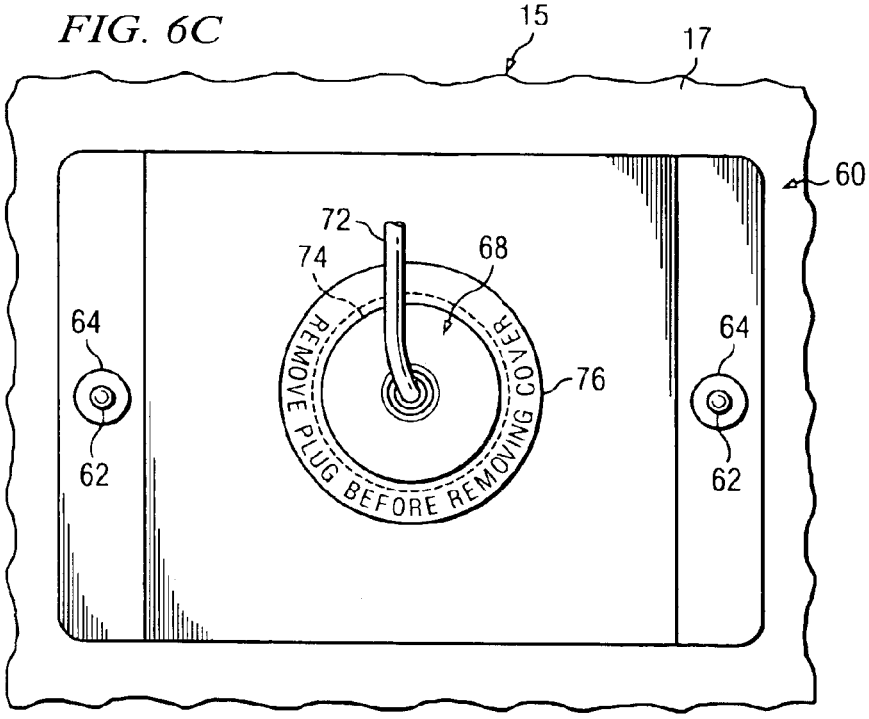
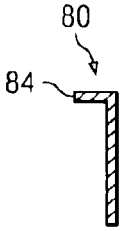
FIG. 7A
FIG. 7B
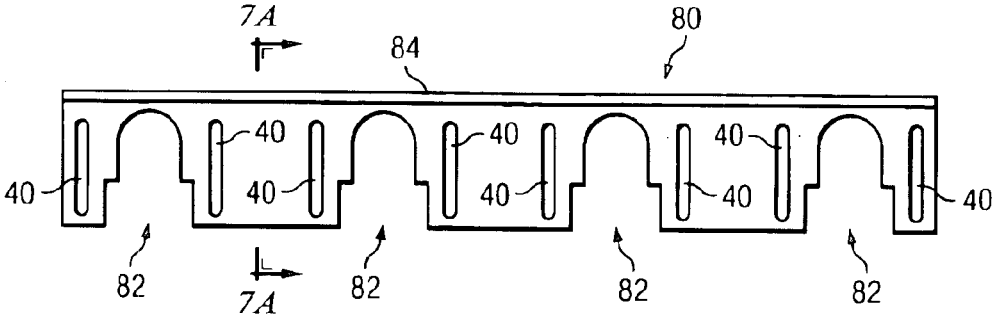

GERMICIDAL LAMP RETAINING ASSEMBLY

CROSS-REFERENCE TO RELATED APPLICATIONS

This application is a continuation-in-part of U.S. Pat. No. 6,539,727 (U.S. Ser. No. 10/026,167) filed Dec. 21, 2001 to Burnett, issued Apr. 1, 2003, entitled "Angled UV Fixture".

STATEMENT OF FEDERALLY SPONSORED RESEARCH OR DEVELOPMENT

Not Applicable

BACKGROUND OF THE INVENTION

1. Technical Field

This invention relates in general to air conditioning systems and, more particularly, to ultraviolet light fixtures.

2. Description of the Related Art

Over the last several years, the use of ultraviolet (UV) light in commercial and residential air conditioning applications has become more popular. A UV light source in the UV-C spectrum, specifically at 253.7 nm, and potentially UV light in other frequencies such as 187 nm, has been shown to be extremely effective in destroying bacteria and fungi in air conditioning systems.

During operation of an air-conditioning system, water condenses on the heat exchanger (typically referred to as the condensing coil). The drain pan is situated below the coil and collects run-off from the coil. Because the cool and moist environmental conditions in the coil are conducive to microbial infestations, UV lamps are often used to illuminate the coil and drain pan. U.S. Pat. No. 5,817,276 to Fencl et al claims that the UV lamp should be oriented perpendicular to the fins of the coil for maximum reflection within the coil.

Mounting a substantially straight lamp perpendicular to the fins, however, has some significant shortcomings. First, in some orientations, the fins will be horizontal in relation to the drain pan. If a substantially linear UV lamp is mounted perpendicular to the drain pan, its effectiveness in killing bacteria in the drain pan may be reduced. Further, mounting a linear UV lamp perpendicular to the fins may result in the use of a relatively short UV lamp, which will not emit as much UV energy as would a longer lamp.

In U.S. Ser. No. 10/026,167, filed Dec. 21, 2001, entitled "Angled UV Fixture" to Burnett, which is incorporated by reference herein, an angled UV lamp fixture is shown. The angled orientation overcomes many of the shortcomings of the prior art.

It is also important that a UV lamp be mounted inexpensively and securely, with precautions taken to reduce the risk of inadvertent UV exposure.

Therefore, a need has arisen for a method and apparatus for UV filtration that maximizes energy to the coil and drain pan for higher microbial efficacy.

BRIEF SUMMARY OF THE INVENTION

In a first aspect of the invention, a mounting system for mounting a germicidal lamp to a sidewall at an angle comprises first and second slide clips. The first slide clip has a planar surface having an opening for engaging the germicidal lamp and an extended portion formed at an angle to said first planar surface, such that the planar surface is held at an desired angle relative to the sidewall when the first slide clip is positioned against the sidewall with the extended portion in contact with the sidewall. The second slide clip has a planar surface with an opening for engaging the germicidal lamp and is slideably engaged with said first slide clip.

In a second aspect of the invention, a germicidal lamp is mounted in a duct. An access cover is coupled to the duct for covering said germicidal lamp, where the access cover has a hole formed therein for receiving an electrical connection to the contacts.

In a third aspect of the invention, an integral piece of material has openings formed therein for receiving a plurality of germicidal lamps. The integral piece of material is secured to a sidewall to mount the germicidal lamps.

BRIEF DESCRIPTION OF THE SEVERAL VIEWS OF THE DRAWINGS

For a more complete understanding of the present invention, and the advantages thereof, reference is now made to the following descriptions taken in conjunction with the accompanying drawings, in which:

FIG. 6*c* illustrates a top view of a flanged plug for use with the security access cover of FIGS. 6*a* and 6*b*; and FIGS. 7*a* and 7*b* illustrate side and front view of a multiple lamp mounting clip.

DETAILED DESCRIPTION OF THE INVENTION

The present invention is best understood in relation to FIGS. 1–7 of the drawings, like numerals being used for like elements of the various drawings.

Figure 1A:
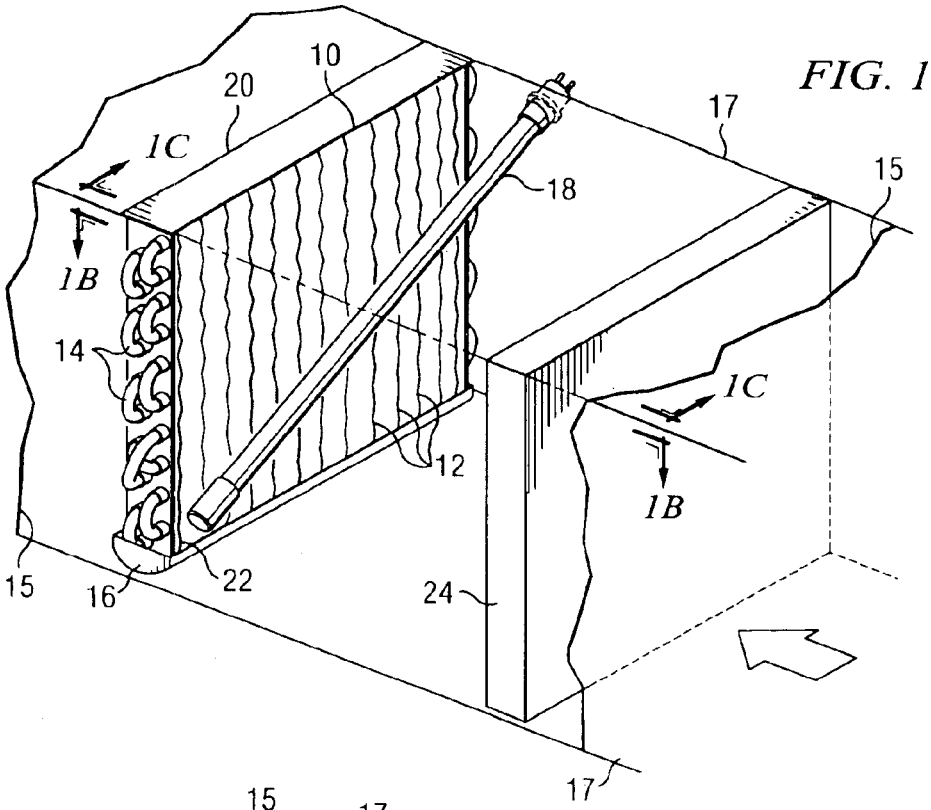
FIG. 1*a* illustrates a perspective view of a coil illuminated by a angled germicidal lamp.

FIG. 1*a* illustrates a generalized perspective view of the present invention. A coil 10, having fins 12 and coolant exchange tubes 14, is disposed in a duct 15 of an air conditioning system. A drain pan 16 is disposed below the coil, such that condensation from the coil 10 flows into the drain pan 16. A germicidal lamp 18 is disposed between a first position near an upper corner 20 of the coil 10 and a second position near opposite lower corner 22. Airflow is shown as passing through a filter 24, which typically precedes the coil 10 in the direction of the airflow. Generally, the airflow is produced by a blower motor (not shown). The blower motor is often placed between the coil 10 and filter 22, although it could also be placed before the filter or after the coil. The relative order of the blower motor, filter 24 and coil 22 is not critical for the operation of the present invention. Also, while the duct of FIG. 1*a* is shown in a horizontal configuration, it could be vertical or at any angle in other configurations. Further, the any type of germicidal lamp 18 could be disposed on either side of the coil, or on both sides. The lamp 18 could be, for example, a single-ended, dual-ended, bi-pin, or mini bi-pin or other configuration. In a dual-ended configuration, an electrical connection to the far side could be made, for example, using a uni-strut angle bracket with the terminal box and electrical connections.

In operation, the air in duct 15 is forced through the coil 10 by a blower motor. The fins 12 are cooled by the coolant exchange tubes 14; hence air passing over the fins is cooled as well. Cooling the air causes condensation to form on the tubes 14 and fins 12. Gravity causes the condensation to flow towards the drain pan 16. The cool moist conditions are ideal for the growth and reproduction of bacteria, mold and other microorganisms on the coil 10 and in the drain pan 16.

The germicidal lamp 18 shines on both the coil 10 and the drain pan 16 Typically, the germicidal lamp is a UVC frequency lamp, which has been shown to be extremely effective in combating bacteria and mold and other airborne organisms. Other frequencies could also be used.

Placing the germicidal lamp 18 at an angle of 10 degrees to 80 degrees to a duct sidewall 17, preferably from a position near one corner of the coil 10 towards an opposite comer of the coil 10 (rather than orienting the lamp horizontally or vertically with respect to a sidewall 17 of duct 15) provides significant benefits. First, the angled disposition of the lamp 18 allows a longer lamp to be used. A longer lamp provides a greater energy output than a shorter lamp of the same intensity. Hence, more energy is available for destroying microorganisms. The increased energy is particularly evident in the drain pan 16.

Figure 1B:
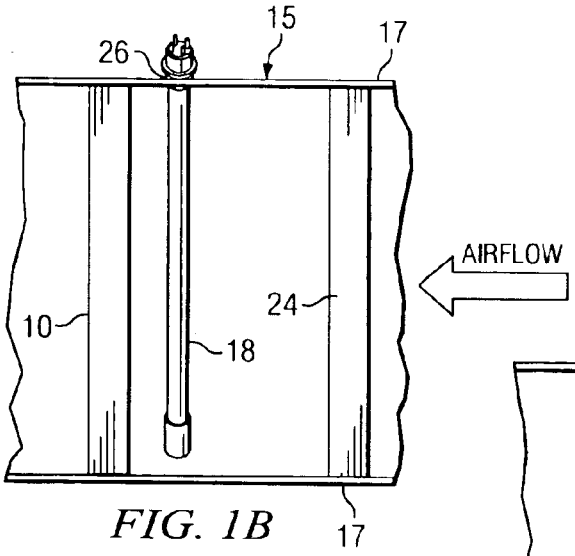
FIGS. 1*b* and 1*c* illustrates top and side cross-sectional views of FIG. 1*a*.
Figure 1C:
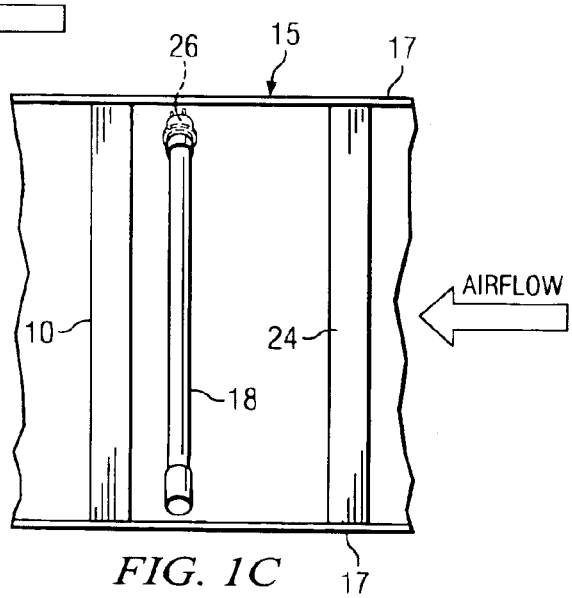

FIGS. 1*b* and 1*c* illustrate top and side views, respectively, of the air conditioning system of FIG. 1*a*. In FIG. 1*b*, an angled mount 26 is shown which allows the germicidal tube 18 to be mounted on a sidewall 17 of duct 15 at a desired angle. Embodiments for the angled mount 26 are shown in greater detail in connection with FIGS. 2–5.

Figure 2:
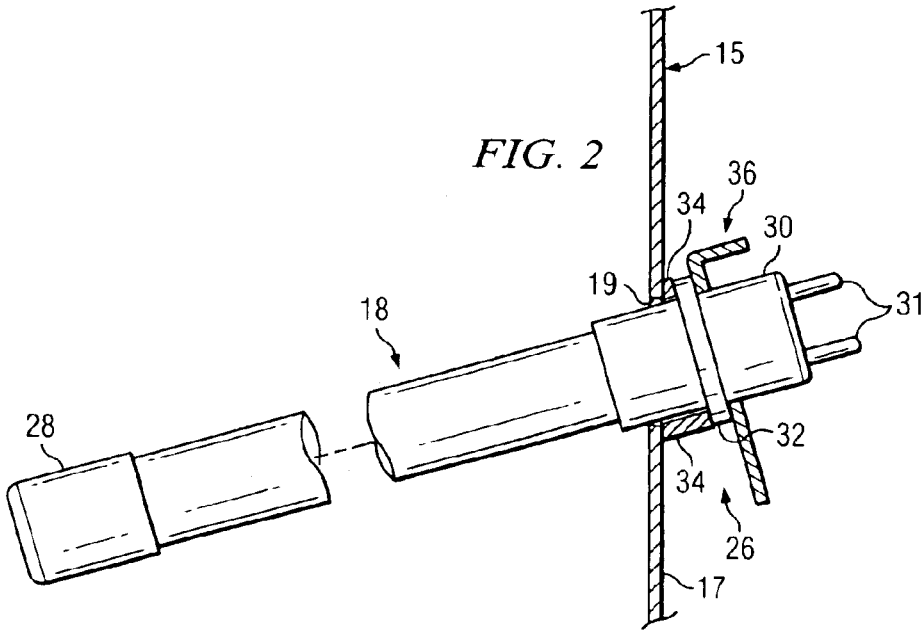
FIG. 2 illustrates a first embodiment of an angled mounting system.

FIG. 2 illustrates a partially cross-sectional view of a first embodiment of an angled germicidal lamp that allows for variable angle positioning. FIG. 2 illustrates a side view of a germicidal lamp 18 disposed through a hole 19 in duct 15 (shown in cross-section) at an angle set by angled mount 26. Germicidal lamp 18 is preferably a single-terminated lamp or doubleterminated lamp with return wires such that all electrical connections are available at one end of the lamp. Lamp 18 includes an endcap 28 at the end of the lamp 18 within the duct 15 and an endcap 30 at the end of the lamp 18 outside of the duct 15. Endcap 30 includes a flange 32 which is oriented in a plane perpendicular to the longitudinal axis of the lamp 18, or at another fixed angle. Electrical contacts 31 protrude endcap 30; these contacts are connected to the ballast.

Angled mount 26 includes angled coupler 34 (shown in cross-section) and restraining mechanism 36. Angled coupler 34 abuts a sidewall 17 of duct 15 and flange 32, thus holding the longitudinal axis of lamp 18 at a desired angle to the plane of the sidewall 17 of duct 15 and, consequently, to the coil 10, as shown in FIG. 1. Restraining mechanism 36 holds the flange 32 and angled coupler 34 fixedly against duct 15.

In typical installations, the coil 10 is accessible from the outside through a "cabinet" or "housing". For purposes of this specification, the cabinet or housing will be considered part of the duct 15. Further, electronics for powering the germicidal lamp 18, commonly referred to as a "ballast", are contained in a housing which is typically secured to the outside of the duct 15. It is possible, and sometimes most efficient, to attach the lamp 18 to the ballast housing; therefore, for purposes of the specification, the ballast housing or any other housing for containing the end of lamp 18, is considered to be part of the pertinent sidewall 17 of duct 15 as well.

Figure 3:
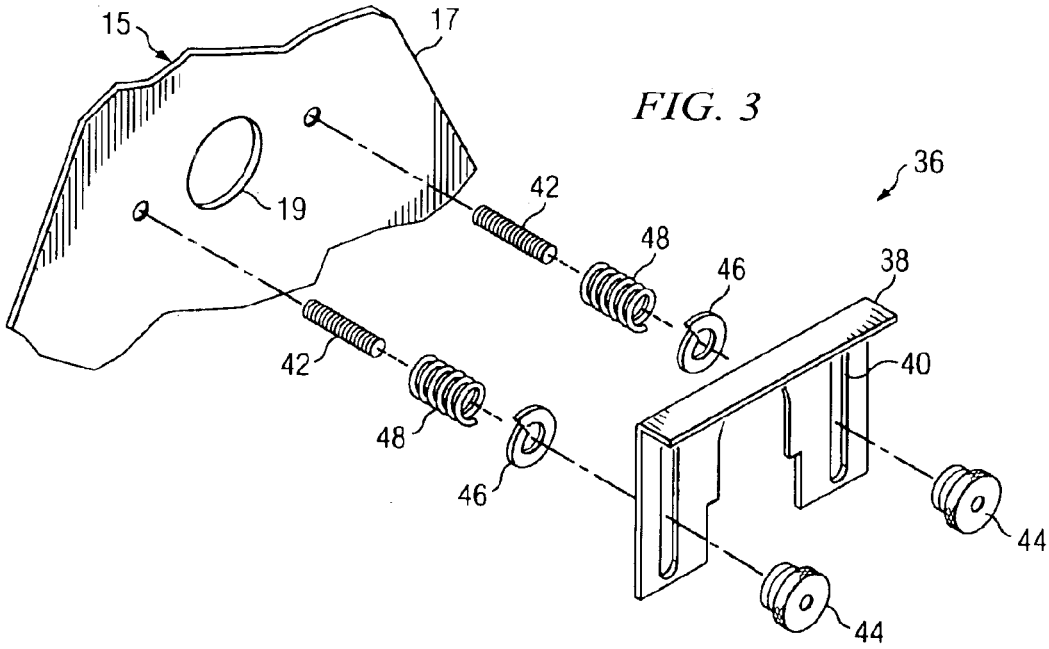
FIG. 3 illustrates an exploded view of a retainer mechanism.

FIG. 3 illustrates an exploded view of a restraining mechanism 36 that could be used in connection with lamp 18 and angled coupler 34 to hold the lamp 18 at the desired angle. Restraining mechanism 36 includes a slide clip 38 with dual slots 40. Threaded studs 42, which are attached to duct 15, are disposed through respective slots 40, such that slide clip 38 can travel up and down in relation to the studs 42 when the restraining mechanism is in an "unlocked" state. Nuts 44 are threaded to screw onto studs 42. On each stud 42, a locking washer 46 and a spring 48 are disposed about stud 42 on the opposite side of slide clip 38 from nuts 44.

Figure 4A:
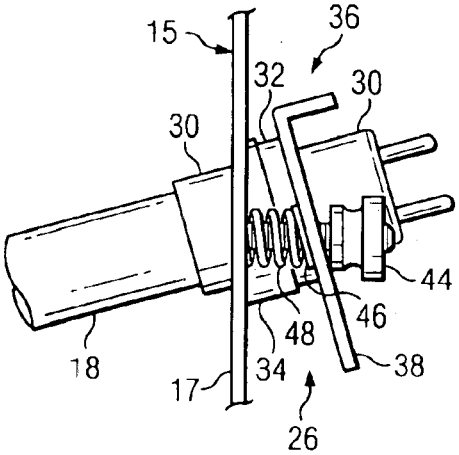
FIGS. 4*a* and 4*b* illustrate side and front views of the retainer mechanism of FIG. 3*a* in a locked position.
Figure 4B:
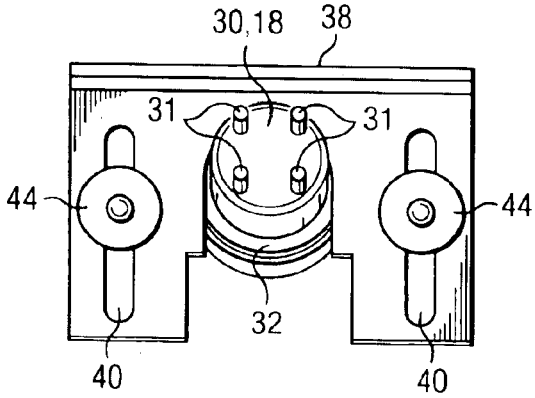

FIGS. 4*a* and 4*b* illustrate side and front views of the restraining mechanism 36 of FIG. 3 in a "locked" position with the nuts 44 tightened to firmly press flange 32 and angled coupler 34 against duct 15 (shown in cross-section in FIG. 4*a*). The slide clip 38 is placed such that the narrow portion of the opening is set against the endcap 30 with the clip 38 pressing against flange 32. In this position, springs 48 press lock nuts 46 against the opposite side of slide clip 38 so that the slide clip is restrained by friction from sliding upwards to an unlocked position.

FIG. 4*b* illustrates a front view of the restraining mechanism in the locked position.

In operation, the angled germicidal lamp shown in FIGS. 1–4 can be used to accommodate a variety of coil configurations and sizes. To mount the germicidal lamp, the installer forms hole 19 in the duct 15 through which the lamp 18 will be installed. Typically, the hole would be located on the duct at a position near an upper corner of the coil 20. The studs 48 are secured to the duct 15 at the sides of the hole 19 (in general, it is beneficial to secure the studs to a plate or chassis to reinforce thinner duct material). A spring 48 and locking washer 46 are placed around each stud 48. Slide clip 38 is placed over the studs 48 and the nuts 44 are placed over the studs 48. An angled coupler 34 is chosen such that the lamp 18 is directed to the opposite corner of the coil 20, as shown in FIG. 1. The selected angled coupler 34 is placed around the lamp 18 and positioned against flange 32 at the opposite end of the lamp 18. The lamp 18 is placed through the hole 19 such that the angled coupler 34 is flush against duct 15 and flange 32 is flush against the angled coupler 34. The slide clip is placed in a locked position against the flange and the nuts 44 are tightened.

In general, the lamp is oriented between two opposite corners, as shown in FIG. 1. The germicidal lamp 18, however, should be angled such that the end of the lamp does not protrude lower than the plane of the top of the drain pan 16. Also, in order to enter at a flat portion of the duct 15, the lamp may be positioned somewhat below the upper corner of the coil 10. Typically, the angle of the longitudinal axis of the lamp will be between 10 and 80 degrees relative to the horizontal plane at the top of the coil 10 or at the edge of the drain pan 16, depending upon the application and the relationship between coil depth, width, height and angle of tilt in the air-handling unit. The lamp 18 could enter the duct at a corner as well, although the mounting may be more difficult.

Figure 5A:
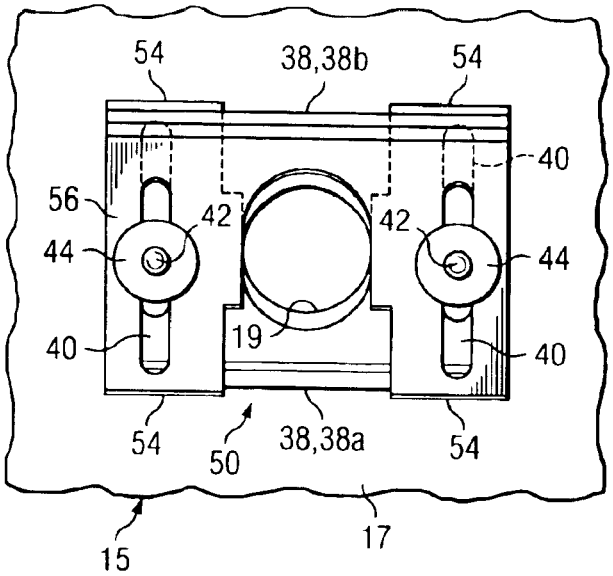
FIGS. 5*a* and 5*b* illustrate top and side views of an alternative embodiment of an angled mounting system.
Figure 5B:
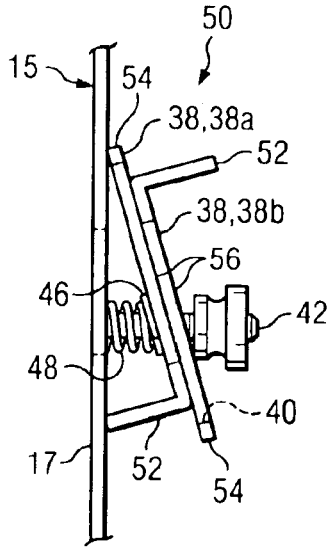

FIGS. 5*a* and 5*b* illustrate an alternative embodiment for angling lamp 18. In this embodiment, an automatically angled restraint mechanism 50 including two slide clips 38 is used to angle the lamp 18. A "bottom" slide clip 38*a* (i.e., the slide clip 38 closest to the sidewall 17) is oriented such that an angled portion 52 and opposite tip 54 cause the planar portion 56 of the clip 38 to form a desired angle with the sidewall 17. The planar portion 56 of "upper" slide clip 38*b* rests against the planar portion 56 of slide clip 38*a*. The slide clips 38*a* and 38*b* are oriented such that a hole is formed in their interiors to expose hole 19 in sidewall 17.

Threaded studs 42, which are attached to sidewall 17, are disposed through overlapping slots 40 of both clips 38*a* and 38*b*, such that the slide clips 38 can travel up and down in relation to the studs 42 when the restraining mechanism is in an "unlocked" state. Nuts 44 are threaded to screw onto studs 42. A locking washer 46 and a spring 48 are disposed about stud 42 between the bottom clip 38*a* and the sidewall 17.

The restraining mechanism 50 provides significant benefits to the installer. First, it is easily and inexpensively manufactured from sheet metal.

Second, it is easily installed at the site. Third, the angled portion 52 can be designed to support different angles, or it can be bent using standard tools at the installation site to provide the proper angle.

Figure 6A:
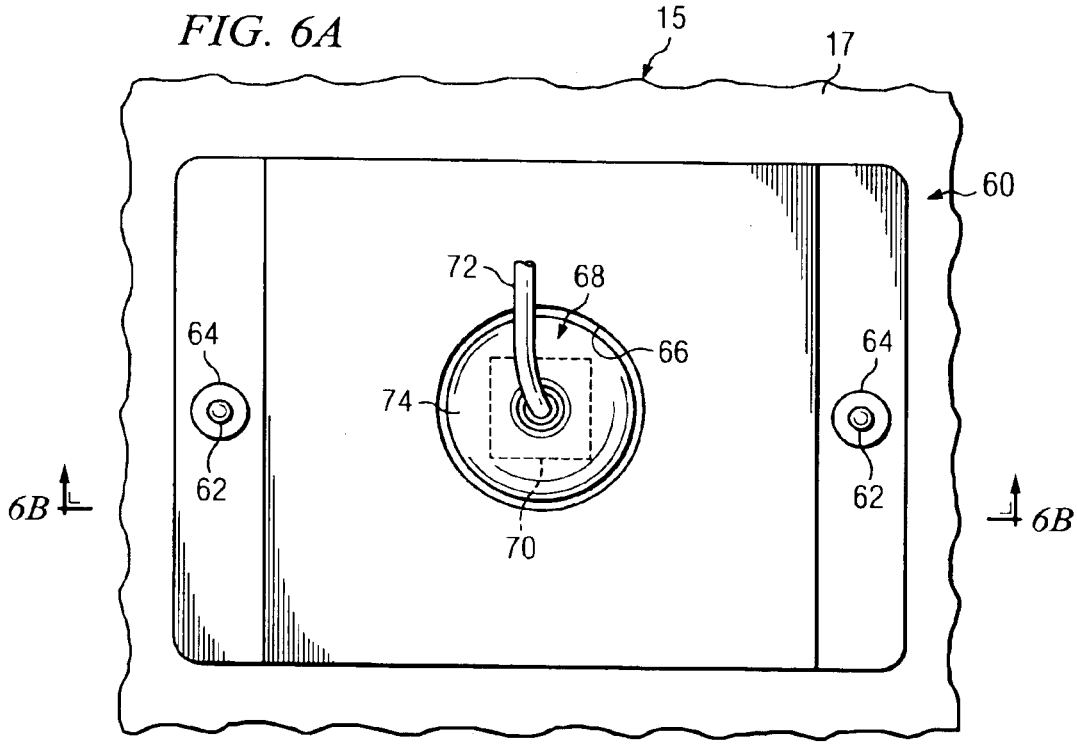
FIGS. 6*a* and 6*b* illustrate top and side views of a security access cover for preventing access to a UV lamp without prior disconnection of the ballast power supply.
Figure 6B:
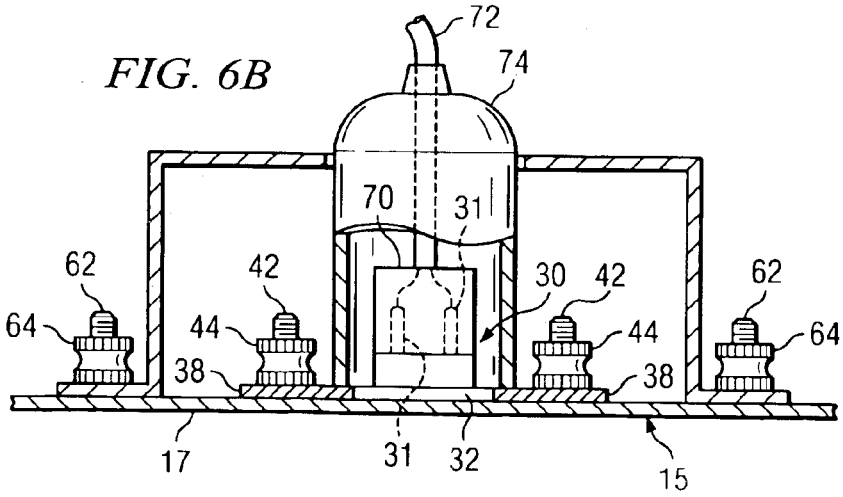

FIGS. 6*a* and 6*b* illustrate a front view and a cross-sectional side view, respectively, of a security access cover 60 for protecting technicians and home owners from possible electrical shock while servicing the UV lamp 18. The security box 60 can be used with any UV lamp orientation, either straight or angled. For ease of illustration, the security access cover 60 is shown in FIG. 6*b* with a straight lamp installation.

The security access cover 60 is attached to sidewall 17 of duct 15 using, for example, studs 62 and nuts 64. The security access cover 60 completely covers the endcap 30 of the lamp 18. An access hole 66 is disposed through the cover to allow access by a plug 68, including female power socket 70, power cable 72, and shield 74 (shown in cutaway view in FIG. 6*b* to expose the power socket 70). The power cable 72 is coupled to the UV ballast (not shown) and supplies power to the pins 31 of lamp 18.

In operation, the security access cover is difficult to remove without first disconnecting the plug 68 from the UV lamp 18. This greatly reduces the possibility of a technician or home owner from UV exposure and from accidental contact with the electrical output of the ballast and prevents anyone from removing the lamp without first disconnecting the lamp from the electricity from the ballast.

FIG. 6*c* illustrates an embodiment of shield 74 where it is impossible to remove the security access cover 60 without first disconnecting the power. In this embodiment, a flange 76 (or other protrusion) is disposed about the top of shield 74, such that the flange 76 is located on the top of security access cover 60 when connected to the UV lamp in normal operation. Any attempt to remove the security access cover 60 will cause the flange to automatically disconnect the socket 70 from the lamp 18. The flange 76 may have text for instructing the individual to remove the plug prior to removing the cover 60.

FIGS. 7*a* and 7*b* illustrate front and side views of a multi-lamp slide clip 80. Multi-lamp slide clip 80 includes a plurality of openings 82, for securing respective lamps 18 to a sidewall of a duct 15 or other casing, formed in an integral sheet of material, such as sheet metal. In the preferred embodiment, two slots 40 are positioned adjacent to each opening 82. An angled extension 84 protrudes from the top of the slide clip 80.

In operation, the multi-lamp slide clip 80 is used to secure multiple lamps 18 to a duct 15 or to other casing. Studs 48 and nuts 44 may be used to hold the multi-lamp slide clip 80 to the sidewall, as shown above in connection with FIG. 3. The lamps 18 can be mounted straight (perpendicular to the sidewall) or at an angle. An angled mount can be achieved by using techniques described above, such as couplers 34 shown in FIG. 2 or by using two multilamp slide clips 80 in the configuration described in connection with FIGS. 5*a* and 5*b*.

The multi-lamp slide clip allows multiple lamps 18 to be easily installed and removed. The lamps 18 could be used for sterilization of a surface of a coil, a filter, or for general air sterilization.

An access cover such as that shown in FIGS. 6*a* and 6*b* could have multiple access holes 66 to cover the lamps secured with the multi-lamp slide clip.

The retaining assemblies described herein could be used not only to illuminate a rectangular coil, as shown in FIG. 1*a*, but also with other coil designs, such as an A-coil, described in connection with U.S. Pat. No. 6,539,727 (U.S. Ser. No. 10/026,167) to Burnett, issued Apr. 1, 2003, entitled "Angled UV Fixture", which is incorporated by reference herein. Additionally, the retaining assemblies could be used in other parts of the air conditioning system to purify filters and other surfaces, and to purify the air itself.

Although the Detailed Description of the invention has been directed to certain exemplary embodiments, various modifications of these embodiments, as well as alternative embodiments, will be suggested to those skilled in the art. The invention encompasses any modifications or alternative embodiments that fall within the scope of the Claims.

What is claimed is:

1. A mounting system for mounting a germicidal lamp to a sidewall at an angle, comprising:

a first slide clip having:

a planar surface having an opening with a first edge for engaging the germicidal lamp; and an extended portion formed at an angle to said first planar surface, such that the planar surface is held at an desired angle relative to the sidewall when the fist slide clip is positioned against the sidewall with the extended portion in contact with the sidewall; and a second slide clip having a planar surface with an opening with a second edge for engaging the germicidal lamp, said second slide clip being slideably engaged with said first slide clip to hold the germicidal lamp between the first and second edges.

2. The mounting system of claim 1 wherein said first slide clip has slots formed in its planar surface and wherein said second slide clip has slots formed in its planar surface, and further comprising studs disposed through the slots.

3. The mounting system of claim 2 and further comprising nuts secured to said studs to hold the first and second slide clips together.

4. The mounting system of claim 2 and further comprising springs disposed about said studs.

5. The mounting system of claim 2 and further comprising locking nuts disposed about said studs.

6. The mounting system of claim 1, wherein said first side clip is manufactured from a bendable material, such that said angle can be adjusted through bending.

7. The mounting system of claim 6 wherein said first side clip is manufactured from sheet metal.

8. The mounting system of claim 6 wherein said angle causes the germicidal lamp to be mounted at an angle between ten and eighty degrees relative to a sidewall.

* * * * *